US005328246A

United States Patent [19]

Sereboff

[11] Patent Number: 5,328,246

[45] Date of Patent: Jul. 12, 1994

[54] DIMENSIONALLY ADJUSTABLE CHAIR

[76] Inventor: Joel L. Sereboff, 2215 Millridge Rd., Owings Mills, Md. 21117

[21] Appl. No.: 919,237

[22] Filed: Jul. 27, 1992

[51] Int. Cl.[5] ..... A47C 7/54

[52] U.S. Cl. ..... 297/411.36; 297/115; 297/440.21

[58] Field of Search ..... 297/115, 118, 411, 412, 297/416–418, 420, 422, 440, 443, 444

[56] References Cited

U.S. PATENT DOCUMENTS

| | | | |
|---|---|---|---|
| 56,718 | 7/1866 | Coomes | 297/444 X |
| 3,206,249 | 9/1965 | Gateley | 297/115 X |
| 3,215,470 | 11/1965 | Swenson et al. | 297/418 X |
| 3,249,387 | 5/1966 | Pivacek | 297/422 X |
| 3,382,000 | 5/1968 | Sully | 297/422 |
| 3,706,473 | 12/1972 | Mullen | 297/440 X |
| 3,938,860 | 2/1976 | Cobb | 297/411 X |
| 4,225,181 | 9/1980 | Lock et al. | 297/416 X |
| 4,620,747 | 11/1986 | Lemmon | 297/440 |
| 5,050,933 | 9/1991 | Tornero et al. | 297/115 X |
| 5,082,329 | 1/1992 | Mars | 297/418 X |
| 5,090,772 | 2/1992 | Ogle et al. | 297/440 |

*Primary Examiner*—Peter M. Cuomo
*Assistant Examiner*—Suzanne L. Dino
*Attorney, Agent, or Firm*—Morton J. Rosenberg; David I. Klein

[57] ABSTRACT

A dimensionally adjustable chair (10) which includes a seat section (14), a back section (16) and front and rear legs (18 and 20) is provided. Arm rest members (22 and 24) may be vertically adjusted above the seat portion (14) through use of a plurality of matingly engaging and interfacing intermediate chair arm members (40) which may be added to or removed at the discretion of the user dependent upon the optimum comfort positioning of the user. Additionally, dimensionally adjustable chair (10) includes back posts (30 and 70) which are aligned with and matingly engaged with a plurality of intermediate back post members (68) to allow vertical adjustment of the back portion (16) of the chair (10). In this manner, the user has at his or her option the ability to provide a comfortable position while sitting.

16 Claims, 1 Drawing Sheet

DIMENSIONALLY ADJUSTABLE CHAIR

FIELD OF THE INVENTION

1. Background of the Invention

This invention relates to dimensionally adjustable furniture such as sofas, chairs and other types of furniture where the user may positionally locate elements to optimize the comfort while the furniture is being used. In particular, this invention directs itself to a dimensionally adjustable chair or sofa system which includes arm rests which may be vertically adjusted with respect to either a base surface or a seat portion of the furniture. More in particular, this invention relates to a dimensionally adjustable chair which allows for the arm rests to interface and matingly engage with intermediate members and are releasably secured thereto. Still further, this invention relates to a dimensionally adjustable piece of furniture where a plurality of intermediate arm members may be sandwiched between the upper surfaces of the front arid rear legs of the piece of furniture on an upper surface thereof and between the arm rest members on a lower surface thereof. Still further, this invention provides for a furniture back portion dimensional adjustment mechanism where intermediate posts are provided which interface with and are sandwiched between an upper post of the back portion of the adjustable chair and lower back post portions in order to allow the user to vertically adjust the back section of the chair or furniture system.

2. Prior Art

Adjustability of different portions of furniture is known in the art. The best prior art known to Applicant includes U.S. Pat. Nos. 3,206,249; 4,277,102; 4,400,033; 4,438,975; 4,489,980; 4,657,305; 4,763,952; 4,815,732; 4,872,727; 5,009,467; and, 5,050,933.

As shown in prior U.S. Pat. No. 5,009,467 such provides for an adjustable arm rest for a chair and such includes bracket members having inner ends with laterally extending slots formed therein and an outer end turned back on itself to form a vertically oriented channel. Bracket plates are provided for attaching the inner ends in superimposed relationship to a collar of the chair and an elbow rest is slidably disposed in the channels. Although such does provide for some positioning, such is not in the concept of the subject invention which allows for a simplicity of elements to be matingly engaged for providing the dimensional adjustment of the subject concept.

SUMMARY OF THE INVENTION

A dimensionally adjustable chair is provided having a seat portion and a back portion as well as a pair of front legs and rear legs for interfacing with an external base surface. A pair of arm rest members are releasably secured to a first pair of the front and rear legs and the other arm rest members releasably secured to a second pair of front and rear legs. Adjustment mechanisms are provided whereby the height of the pair of arm rest members with respect to an upper surface of each of the front and rear legs may be made in a releasable coupling mode of operation.

BRIEF DESCRIPTION OF THE DRAWINGS

FIG. 3 is an exploded view in perspective showing intermediate back post members for alignment and mating engagement to respective back post portions of the adjustable chair;

DESCRIPTION OF THE PREFERRED EMBODIMENTS

Figure 1:
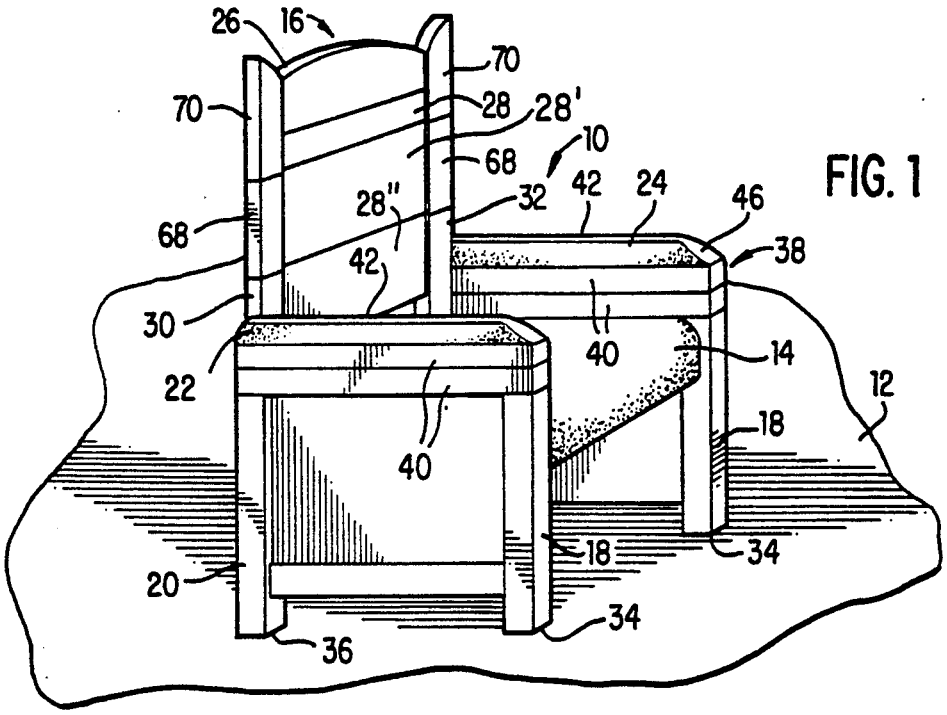
FIG. 1 is a perspective view of the dimensionally adjustable chair showing the subject concept.

Referring now to FIGS. 1–4, there is shown dimensionally adjustable chair 10 which rests on base surface 12. Dimensionally adjustable chair 10 is provided for adjusting the height above base surface 12 of arm rest members 22 and 24 as well as above seat portion 14 of chair 10. In this manner, a user may rest his or her arms on an upper surface of arm rest members 22 and 24 in a comfort optimized position while sitting in chair 10. The positional location and positioning of arm rest members 22 and 24 is particularly useful with respect to persons having arthritic or bone conditions which require particular positioning of the user's arms to provide an acceptable comfort level. Additionally, chair 10 with the particular dimensioning mechanisms to be described in following paragraphs allows a variance in the height of different users while maintaining a comfortable sitting position for persons having a wide disparity of heights. Additionally, chair 10 as will be described in following paragraphs includes back portion 16 which is vertically adjustable at the discretion of the user to once again provide an increased comfort positioning mechanism which optimizes the comfort of persons using chair 10.

Seat portion 14 of chair 10 is secured to the overall frame of chair 10 in the usual well known manner of bolting, pegging, or some other technique not important to the inventive concept as herein described. Seat portion 14 may be a resilient fabric type member or alternatively may be formed of a wood or plastic composition.

Chair back portion 16 may include back bridge member 26 and central back panel portions 28, 28' and 28'' which are mounted between back post members 30 and 32 as is shown. The backing portion 16 of chair 10 may be formed sectionally into panels 28, 28' and 28'' to allow insertion and removal associated with back adjustable elements to be described in following paragraphs.

Chair 10 includes a pair of chair front legs 18 each having a lower surface 34 for interfacing with base surface 12 as is seen in FIG. 1. Additionally, chair rear legs 20 further include lower surface 36 for similarly interfacing with base surface 12.

Each of arm rest members 22 and 24 are associated with a pair of front and rear leg members 18 and 20 as is shown. Arm rest member 22 is mounted to and between a first pair of front and rear leg members 18 and 20 with arm rest member 24 being mounted between a second pair of front and rear leg members 18 and 20 as is shown. Arm rest members 22 and 24 are releasably secured to respective first and second pairs of front and rear legs 18 and 20.

Chair 10 further includes adjustment mechanism 38 for adjusting the height of arm rest members 22 and 24 with respect to an upper surface of each of front and rear legs 18 and 20. Adjustment mechanism 38 allows for releasable coupling of arm rest members 22 and 24 to front and rear legs 18 and 20 as will be described in following paragraphs.

Still further, chair 10 and adjustment mechanism 38 provides a mechanism for releasably coupling arm rest members 22 and 24 to respective first and second front and rear legs 18 and 20 which allows versatility of use and varying heights to be made at the discretion of the user of chair 10.

Figure 2:
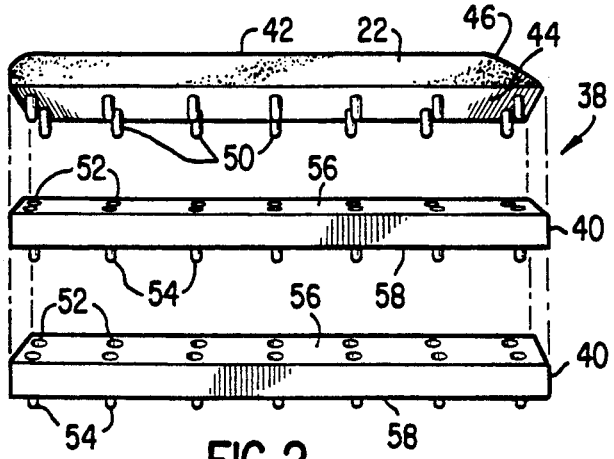
Figure 4:
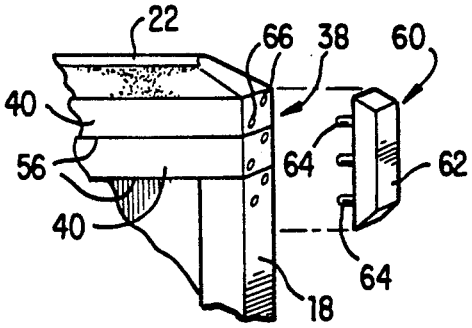
FIG. 4 is a partial cutaway perspective view of a structural reinforcement mechanism to maintain the height adjustment elements in a stabilized manner; and, FIG. 5 is an elevational view of an embodiment of the adjustable chair showing a tongue-in-groove coupling between arm members.

Referring now to FIGS. 2 and 4, adjustable chair 10 having adjustment mechanism 38 includes intermediate chair arm members 40 as shown which are insertable between and releasably secured to arm rest members 22 and 24 and further to another intermediate chair arm member 40 or to front and rear legs 18 and 20. Arm rest members 22 and 24 include arm rest member upper surfaces 42 and lower surfaces 44 for contiguous interface with one of intermediate chair arm members 40 as is seen in FIGS. 1, 2 and 4. Arm rest members 22 and 24 may include inclined frontal sections 46 which may aid in the comfort of a user when there is contiguous interface with the arm portion of the body of a chair user. Additionally, both of arm rest members 22 and 24 are shown to be linearly directed with regard to upper surfaces 42 however, obviously, arm rest members 22 and 24 may have varying contours not important to the inventive concept as herein described.

Arm rest members 22 and 24 having lower surfaces 44 as is seen in FIGS. 1 and 2 by necessity are provided for interfacing in a mating engagement with a next set of elements. Thus, in general, although not necessary, lower surfaces 44 are substantially planar and further include pre-positioned arm rest peg members 50 extending substantially normal to lower surfaces 44 as is shown. Pre-positioned arm rest peg members 50 are fixedly secured to respective arm rest members 22 and 24. Fixed securement between peg members 50 and each of arm rest members 22 and 24 may be provided by adhesive securement, bolting or some like technique.

Intermediate chair arm members 40 are generally contoured in the envelope of a paralelepiped. Intermediate chair arm members 40 include intermediate member upper surfaces 56 and intermediate member lower surfaces 58. As clearly seen in FIG. 2, intermediate member upper surfaces 56 include a plurality of intermediate chair arm member pre-positioned openings 52 and intermediate member lower surfaces 58 have extending therefrom a plurality of pre-positioned intermediate chair arm member peg members 54.

Peg members 54 are positionally located in a manner to allow insert into respective pre-positioned openings 52 of a succeeding intermediate chair arm member 40 as is shown. Pre-positioning of peg members 54 and openings 52 are provided for mating engagement and insertion of peg members 54 into openings 52 as well as peg members 50 of arm rest members 22 and 24 into respective Openings 52 of intermediate chair arm members 40.

In this manner, the overall height and dimensional vertical distance of arm rest members 22 and 24 may be adjusted by the user at his or her discretion.

In some instances it may be of importance to provide for structural reinforcement mechanism 60 as is shown in FIG. 4. As seen, structural reinforcement mechanism 60 matingly engages with arm rest members 22 and 24 as well as intermediate chair arm members 40 and front legs 18. Structural reinforcement mechanism 60 includes side member 62 having prelocated side member pegs 64 extending from one surface for insert into aligned openings 66 formed in respective legs 18, intermediate chair arm members 40, and arm rest members 22 and 24. In this manner, a rigidized structural coupling is provided between arm rest members 22, intermediate members 40, and front legs 18. Obviously, side members 62 may be mounted on rear legs 20 of chair 10 in a similar manner to that which is shown in FIG. 4 for front legs 18.

Figure 3:
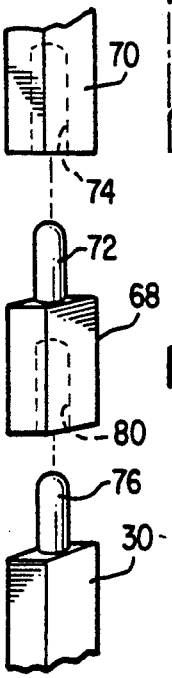
FIG. 3 is a perspective partial blowup view of an arm rest of the chair showing positional relationship with intermediate chair arm members.

Back portion 16 of chair 10 is seen to be formed of back bridge member 26 coupling on opposing sides thereof upper back post members 70 which interface with intermediate back post members 68. Intermediate back post members 68 are sandwiched between upper back post members 70 and respective back post members 30 and 32 as is seen. Referring to FIG. 3, intermediate back post member 68 includes intermediate back post peg member 72 formed on and extending from an upper surface thereof. Peg member 72 is insertable within opening or recess 74 formed within upper back post member 70 as is seen in FIG. 3. Additionally, in similar manner, back post members 30 and 32 have associated with them back post peg members 76 for insert into a respective opening 80 as shown. It is to be understood that peg members 72, 76 may be force fit or otherwise lockingly engaged within respective recesses 74, 80 to provide a fixed securement between respective elements.

Obviously, pluralities of intermediate back post member 68 may be provided for nesting or mating engagement with a next succeeding back post member 68 to further adjust the height of the combined back post members 30, intermediate back post members 68, and upper back post members 70.

Panel members 28, 28' and 28'' may be associated respectively with post members 70, intermediate back post members 68 and back post members 30, 32. Panel members 28, 28' and 28'' may be fixedly secured to respective back post members or alternatively may be removably secured thereto through a tongue-in-groove fastening or some like mechanism.

In a manner similar to that shown in FIG. 4 for arm rest members 22 and 24, coupling of respective intermediate back post members 68 may be provided through some type of side member which may operate and function as that provided for side member 62 as previously described.

Intermediate back post members 68 as well as intermediate members 40 may be formed of wood, plastic or some like material composition not important to the inventive concept as herein described.

Figure 5:
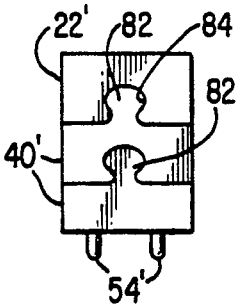

Referring to FIG. 5, there is an alternate embodiment shown for attaching intermediate chair arm members 40' each to the other and to arm rest member 22'. As seen, a tongue 82 of each-member 40' may be inserted into a corresponding groove 84 of a next succeeding member 40' or 22'. In this manner a locking engagement may be provided through sliding interface. Peg members 54' may be inserted in the manner previously described for peg members 54, however it is to be understood that peg members 54' may be replaced with a tongue-in-groove coupling in cooperation with an upper surface configuration of front legs 18 and rear legs 20.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. A dimensionally adjustable chair comprising:

(a) a seat portion;

(b) a back portion for contiguously interfacing with a user's back;

(c) a pair of chair front legs, each having a lower surface for interfacing with a base surface;

(d) a pair of chair rear legs each having a lower surface for interfacing with said base surface;

(e) a pair of arm rest members, one of said arm rest members releasably secured to a first pair of said front and rear legs and the other of said arm rest members releasably secured to a second pair of said front and rear legs; and (f) means for adjusting the height of said pair of said arm rest members with respect to an upper surface of each of said front and rear legs, said adjustment means being releasably coupled to said arm rest members and said front and rear legs, said means for adjusting the height of said pair of said arm rest members including at least one intermediate chair arm member insertable between and releasably secured to at least one of said arm rest members and one of said first or second pair of said front and rear legs.

2. The dimensionally adjustable chair as recited in claim 1 where each of said arm rest members includes an upper surface for contiguous interface with a portion of the body of a user and a lower surface for contiguous interface with one of said intermediate chair arm members.

3. The dimensionally adjustable chair as recited in claim 2 where each of said arm rest members lower surfaces is substantially planar having pre-positioned arm rest peg members extending substantially normal to said lower surfaces.

4. The dimensionally adjustable chair as recited in claim 3 where said pre-positioned arm rest peg members are fixedly secured to respective arm rest members.

5. The dimensionally adjustable chair as recited in claim 3 where said intermediate chair arm members are formed in a contour envelope of a paralelepiped.

6. The dimensionally adjustable chair as recited in claim 3 where said intermediate chair arm members includes an upper surface having pre-positioned openings formed therein and a lower surface having intermediate chair arm member pegs extending therefrom.

7. The dimensionally adjustable chair as recited in claim 6 where said pre-positioned arm rest peg members are aligned with said pre-positioned openings formed in one of said intermediate chair arm members for mating engagement of said arm rest member to said intermediate chair arm member.

8. The dimensionally adjustable chair as recited in claim 7 where said pre-positioned intermediate chair arm member pegs are aligned with pre-positioned openings formed in a next succeeding intermediate chair arm member for mating engagement of one of said intermediate chair arm members to a next succeeding intermediate chair arm member.

9. The dimensionally adjustable chair as recited in claim 7 where a plurality of said intermediate chair arm members are matingly engaged each to the other for adjusting the height of said arm rest members with respect to said first and second pairs of said front and rear legs.

10. The dimensionally adjustable chair as recited in claim 7 including means for structurally reinforcing said matingly engaged arm rest members, said intermediate chair arm members and said front legs.

11. The dimensionally adjustable chair as recited in claim 10 where said means for structural reinforcement includes at least one side member having pre-located side member pegs extending therefrom for insert into aligned openings formed in respective chair legs, intermediate chair arm members, and arm rest members.

12. A dimensionally adjustable chair comprising:

(a) a seat portion;

(b) a back portion for contiguously interfacing with a user's back, said chair back portion including a pair of back post members, each of said back post members having an upper surface adapted for releasable securement to an upper set of back post members;

(c) at least a pair of intermediate back post members releasably securable to said back post members and said upper back post members for extending the height of said chair back portion;

(d) a pair of chair front legs each having a lower surface for interfacing with a base surface;

(e) a pair of chair rear legs each having a lower surface for interfacing with said base surface;

(f) a pair of arm rest members, one of said arm rest members releasably secured to a first pair of said front and rear legs and the other of said arm rest members releasablys ecured to a second pair of said front and rear legs; and, (g) means for adjusting the height of said pair of said arm rest members with respect to an upper surface of each of said front and rear legs, said adjustment means being releasably coupled to said arm rest members and said front and rear legs.

13. The dimensionally adjustable chair as recited in claim 12 where said intermediate back post members includes opposing ends having respectively (1) a back post peg member extending from one end thereof; and, (2) a back post opening formed within an opposing end for mating engagement with a next succeeding intermediate back post member or said back post members.

14. The dimensionally adjustable chair as recited in claim 13 where each of said intermediate back post members includes a paralelepiped contour.

15. The dimensionally adjustable chair as recited in claim 14 where said intermediate back post members are formed of a plastic material composition.

16. The dimensionally adjustable chair as recited in claim 15 where said intermediate back post members are formed of wood.

* * * * *